US007948452B2

(12) United States Patent
Sato et al.

(10) Patent No.: US 7,948,452 B2
(45) Date of Patent: May 24, 2011

(54) SELF-EMISSION TYPE DISPLAY DEVICE

(75) Inventors: Masatoshi Sato, Gifu (JP); Hitoshi Yasuda, Gifu (JP); Kazumasa Takai, Gifu (JP); Tomonori Matsumuro, Kyoto (JP)

(73) Assignee: Sanyo Electric Co., Ltd., Osaka (JP)

( * ) Notice: Subject to any disclaimer, the term of this patent is extended or adjusted under 35 U.S.C. 154(b) by 690 days.

(21) Appl. No.: 11/516,732

(22) Filed: Sep. 7, 2006

(65) Prior Publication Data

US 2007/0057878 A1 Mar. 15, 2007

(30) Foreign Application Priority Data

Sep. 12, 2005 (JP) ..... 2005-263298

(51) Int. Cl.
*G09G 3/30* (2006.01)

(52) U.S. Cl. ..... 345/76

(58) Field of Classification Search ..... 345/76–82; 315/169.3

See application file for complete search history.

(56) References Cited

U.S. PATENT DOCUMENTS 5,706,036 A * 1/1998 Lam et al. ..... 345/213
5,861,908 A * 1/1999 Tonosaki et al. ..... 348/57
5,990,979 A * 11/1999 Koyama et al. ..... 348/674
6,144,354 A * 11/2000 Koyama et al. ..... 345/98
6,414,661 B1 * 7/2002 Shen et al. ..... 345/82
2004/0164936 A1 * 8/2004 Lim ..... 345/76
2004/0164938 A1 * 8/2004 Choi et al. ..... 345/76
2005/0030267 A1 * 2/2005 Tanghe et al. ..... 345/82
2005/0156820 A1 * 7/2005 Aoki ..... 345/58

FOREIGN PATENT DOCUMENTS

JP 2003-228328 8/2003

* cited by examiner

*Primary Examiner* — Amr Awad
*Assistant Examiner* — Kenneth Bukowski
(74) *Attorney, Agent, or Firm* — Morrison & Foerster LLP

(57) ABSTRACT

The invention provides an organic EL display device usable for both negative and positive polarity video signals. The organic EL display device of the invention has a polarity switching circuit switching a polarity of a digital video signal. In a case where a display panel is made for a negative polarity video signal, when a negative digital video signal is inputted, this polarity switching circuit lets the negative polarity digital video signal pass therethrough without inverting its polarity. When a positive polarity digital video signal is inputted, this polarity switching circuit inverts a polarity of the positive polarity digital video signal and inverts and switches reference data for a white level and reference data for a black level in order to obtain an accurate inverted image. An output of the polarity switching circuit is converted into an analog video signal through a first D/A converter and outputted to the display panel.

6 Claims, 5 Drawing Sheets

SELF-EMISSION TYPE DISPLAY DEVICE

CROSS-REFERENCE OF THE INVENTION

This application claims priority from Japanese Patent Application No. 2005-263298, the content of which is incorporated herein by reference in its entirety.

BACKGROUND OF THE INVENTION

1. Field of the Invention

The invention relates to a self-emission type display device, for example, a display device using an organic electroluminescent element as a self-emissive element.

2. Description of the Related Art

An organic electroluminescent (referred to as "EL", hereafter) display device using an organic EL element as a self-emissive element has been developed as a display device replacing a CRT or an LCD in recent years. Particularly, an active matrix type organic EL display device that has a driving transistor driving an organic EL element in response to a video signal has been developed.

Generally, there are a negative polarity video signal and a positive polarity video signal as the kinds of the video signal that is inputted to the organic EL display device, and the organic EL display devices conventionally need be provided for these negative and positive video signals respectively.

FIG. 5 is a circuit diagram of a pixel of the organic EL display device for the negative polarity video signal. The negative polarity video signal applied to a data line DL is applied to a gate of a P-channel type driving transistor 2A through an N-channel type pixel selection transistor 1 where on and off are controlled by a gate signal from a gate line GL. Then, a drive current corresponding to the negative polarity video signal flows in the driving transistor 2A, and then supplied to an organic EL element 3. The larger this drive current is, the higher the luminance when the organic EL element 3 emits light is.

In the negative polarity video signal, a reference potential Ref(H) on a high potential side corresponds to a black level, and a reference potential Ref(L) on a low potential side corresponds to a white level. Therefore, the driving transistor 2A is set to the P-channel type so that the drive current of the driving transistor becomes larger as the negative polarity video signal is lower.

On the other hand, FIG. 6 is a circuit diagram of a pixel of the organic EL display device for the positive polarity video signal. The positive polarity video signal applied to the data line DL is applied to a gate of an N-channel type driving transistor 2A through an N-channel type pixel selection transistor 1 where on and off are controlled by a gate signal from the gate line GL. Then, a drive current corresponding to the positive polarity video signal flows in the driving transistor 2A, and then supplied to the organic EL element 3. The larger this drive current is, the higher the luminance when the organic EL element 3 emits light is.

In the positive polarity video signal, a reference potential Ref(H) on a high potential side corresponds to a white level, and a reference potential Ref(L) on a low potential side corresponds to a black level. Therefore, the driving transistor 2A is set to the N-channel type so that the drive current of the driving transistor becomes larger as the positive polarity video signal is larger. The relevant technology is described in Japanese Patent Application Publication No. 2003-228328.

The organic EL display devices need be provided for the negative polarity video signal and the positive polarity video signal respectively as described above. That is, the organic EL display device of FIG. 5 for the negative polarity video signal can not be used for the positive polarity video signal, and the organic EL display device of FIG. 6 for the positive polarity video signal can not be used for the negative polarity video signal.

SUMMARY OF THE INVENTION

The invention provides a display device that includes a polarity switching circuit receiving and outputting a digital video signal. The polarity switching circuit is configured to output the digital video signal without inverting a polarity thereof when the polarity of the received digital video signal is a first polarity and to invert the digital video signal so as to be of the first polarity and output the inverted digital video signal when the polarity of the received digital video signal is a second polarity that is opposite to the first polarity. The display device also includes a first D/A converter converting the digital video signal output by the polarity switching circuit with or without the inversion to an analog video signal, and a self-emissive element emitting light based on a drive current supplied to the self-emissive element in response to the analog video signal.

DETAILED DESCRIPTION OF THE INVENTION

Figure 1:
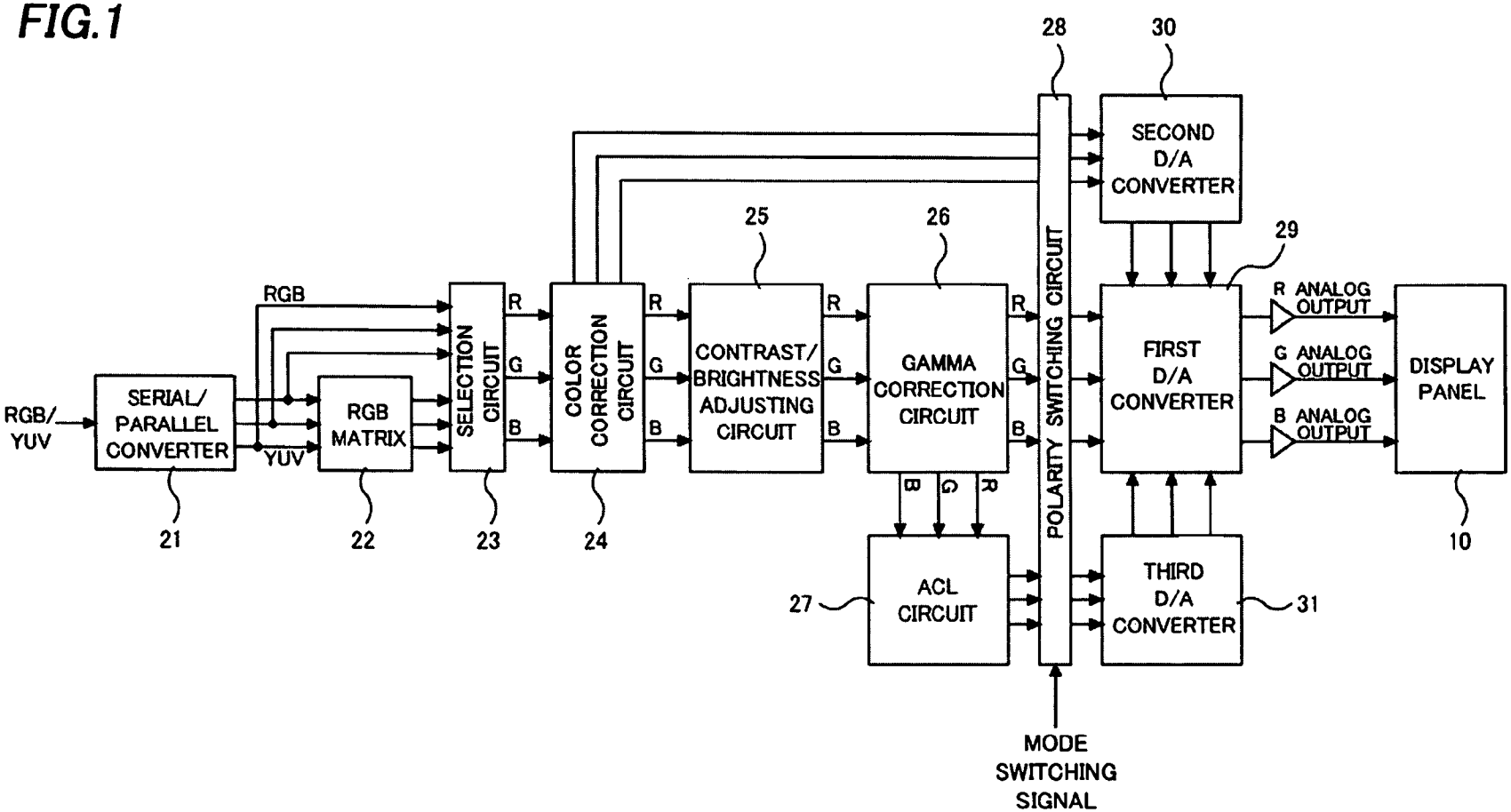
FIG. 1 is a block diagram of a self-emission type display device of an embodiment of the invention.
Figure 5:
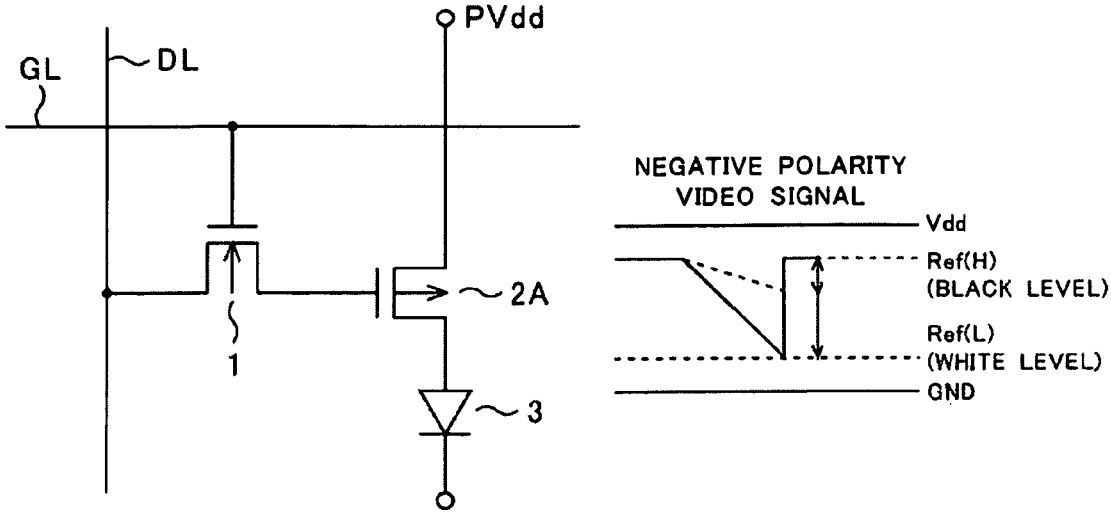
FIG.5 PRIOR ART
FIG. 5 is a circuit diagram of a pixel of an organic EL display device for a negative polarity video signal.
Figure 6:
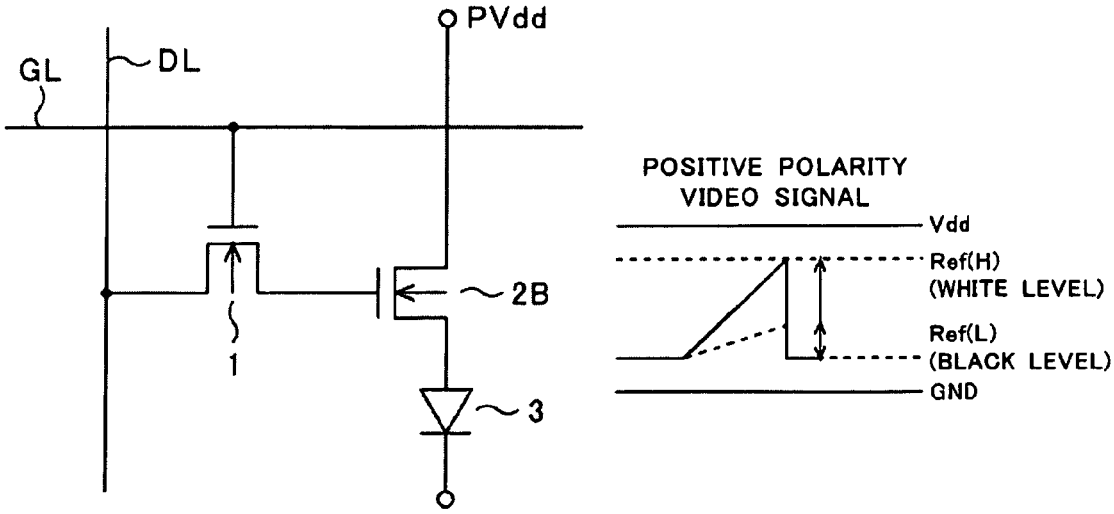
FIG.6 PRIOR ART
FIG. 6 is a circuit diagram of a pixel of an organic EL display device for a positive polarity video signal.

A structure of a self-emission type display device of an embodiment of the invention will be described referring to figures. This self-emission type display device has a display panel 10 including a pixel region where pixels of FIG. 5 or 6 are arrayed in a matrix, different kinds of video signal processing circuits performing signal processing to a RGB digital video signal inputted from outside (a serial/parallel converter 21, an RGB matrix 22, a selection circuit 23, a color correction circuit 24, a contrast/brightness adjusting circuit 25, a gamma correction circuit 26, and an automatic contrast limiter (referred to as "ACL" hereinafter) circuit 27), a polarity switching circuit 28 switching a polarity of a processed digital video signal or the like, a first D/A converter 29 D/A-converting the RGB video signal from the polarity switching circuit 28, a second D/A converter 30 D/A-converting reference data on a high potential side from the polarity switching circuit 28, and a third D/A converter 31 D/A-converting reference data on a low potential side from the polarity switching circuit 28, as shown in a block diagram of FIG. 1. An RGB analog video signal as an output of the first D/A converter 29 is supplied to each of the pixels of the display panel 10.

A structure and an operation of each of the circuits will be described hereafter. The serial/parallel converter 21 converts an RGB digital video signal, and a YUV signal including a luminance signal and a color-difference signal, which are serial signals, into parallel signals. The YUV signal that is one of these parallel signals is converted into an RGB digital video signal by the RGB matrix 22. Either one of the RGB digital video signal outputted from the serial/parallel converter 21 or the RGB digital video signal converted from the YUV signal by the RGB matrix 22 is selected by the selection circuit 23 and outputted.

The digital video signal from the selection circuit 23 is inputted to the color correction circuit 24 performing predetermined color correction. The digital video signal corrected in color by the color correction circuit 24 is inputted to the contrast/brightness adjusting circuit 25 adjusting the contrast or brightness of the signal. The digital video signal adjusted in contrast and brightness by the contrast/brightness adjusting circuit 25 is inputted to the gamma correction circuit 26 performing gamma correction. The digital video signal gamma-corrected by the gamma correction circuit 26 is inputted to the polarity switching circuit 28.

The gamma-corrected digital video signal is inputted to the ACL circuit 27. The ACL circuit 27 is a circuit adjusting the white level of the digital video signal for controlling the luminance of the display panel 10. Reference data on a low potential side outputted from the ACL circuit 27 is inputted to the polarity switching circuit 28. Reference data on a high potential side outputted from the color correction circuit 24 is also inputted to the polarity switching circuit 28.

The polarity switching circuit 28 has functions of inverting the polarity of the digital video signal and switching the white level and the black level in order to obtain an accurate inverted image, according to the characteristics of the display panel 10.

Figure 2:
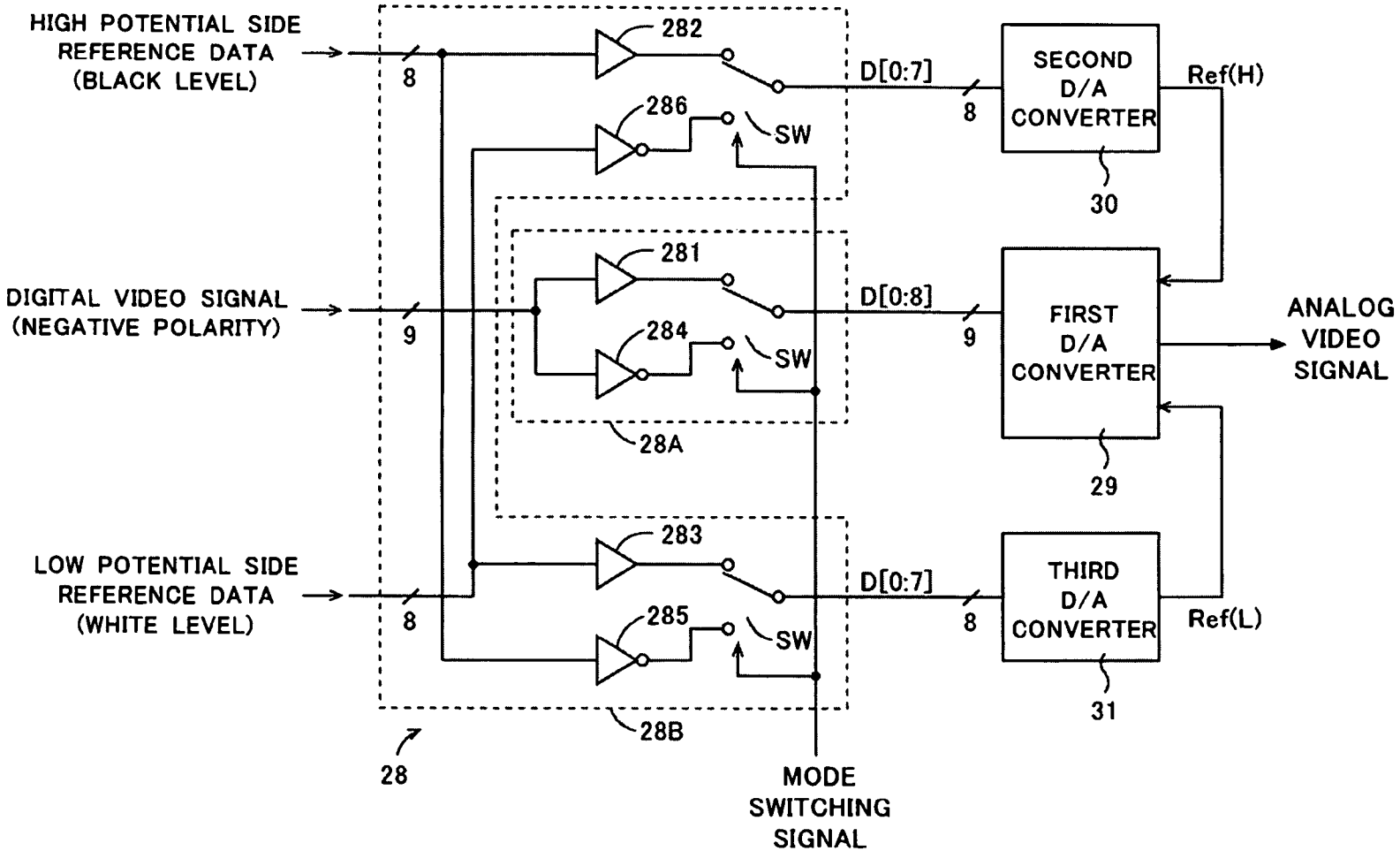
FIG. 2 is a circuit diagram of a polarity switching circuit 28 of FIG. 1.
Figure 4:
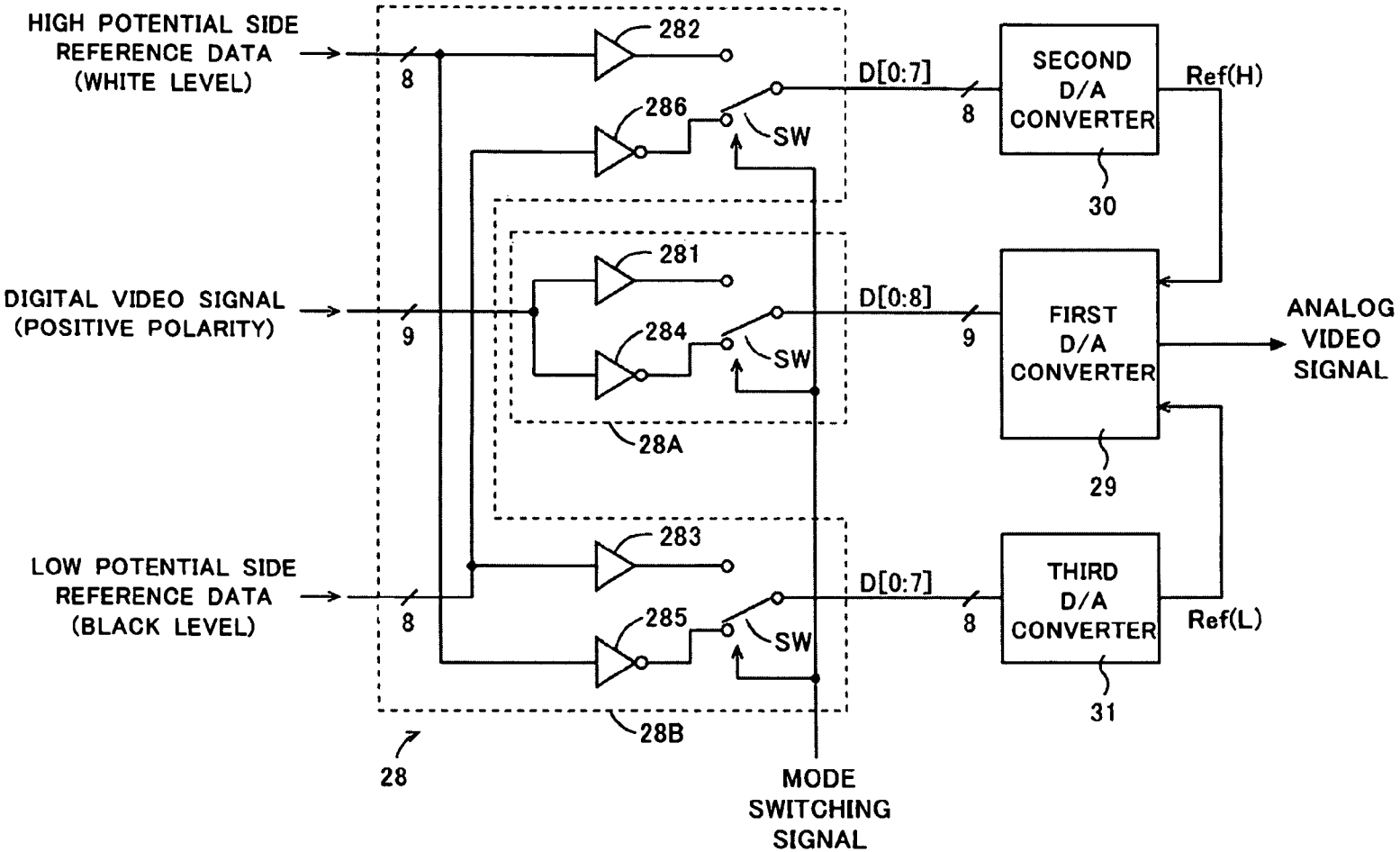
FIG. 4 is a circuit diagram of the polarity switching circuit 28 of FIG. 1.

FIG. 2 is an example of a circuit diagram of the polarity switching circuit 28 when the negative polarity digital video signal is inputted. FIG. 4 is an example of a circuit diagram of the polarity switching circuit 28 when the positive polarity digital video signal is inputted. The polarity switching circuit 28 has a first polarity switching circuit 28A having a function of inverting the polarity of the digital video signal and a second polarity switching circuit 28B having a function of switching the reference data on the high potential side and the reference data on the low potential side and inverting these polarities. FIGS. 2 and 4 show the structure of the polarity switching circuit for one color in the RGB digital video signal and the reference data.

An operation of the polarity switching circuit 28 is explained supposing that the display panel 10 is made for the negative polarity video signal (the display panel having the pixels of FIG. 5). As shown in FIG. 2, when the negative polarity digital video signal is inputted to the first polarity switching circuit 28A through the gamma correction circuit 26, a switch SW is switched in response to a mode switching signal, and the negative polarity video signal is inputted to the first D/A converter 29 through a non-inverting amplifier 281 of the first polarity switching circuit 28A. That is, the negative polarity digital video signal is inputted to the first D/A converter 29 as it is without being inverted.

Reference data on the high potential side from the color correction circuit 24 corresponds to the black level, and is digital data of 8 bits, for example. The reference data on the high potential side is inputted to the second D/A converter 30 through the non-inverting amplifier 282. Reference data on the low potential side from the ACL circuit 27 corresponds to the white level, and is digital data of 8 bits, for example. The reference data on the low potential side is inputted to the third D/A converter 31 through the non-inverting amplifier 283. That is, these reference data are inputted to the second D/A converter 30 and the third D/A converter 31 without being inverted, as well, respectively.

Figure 3:
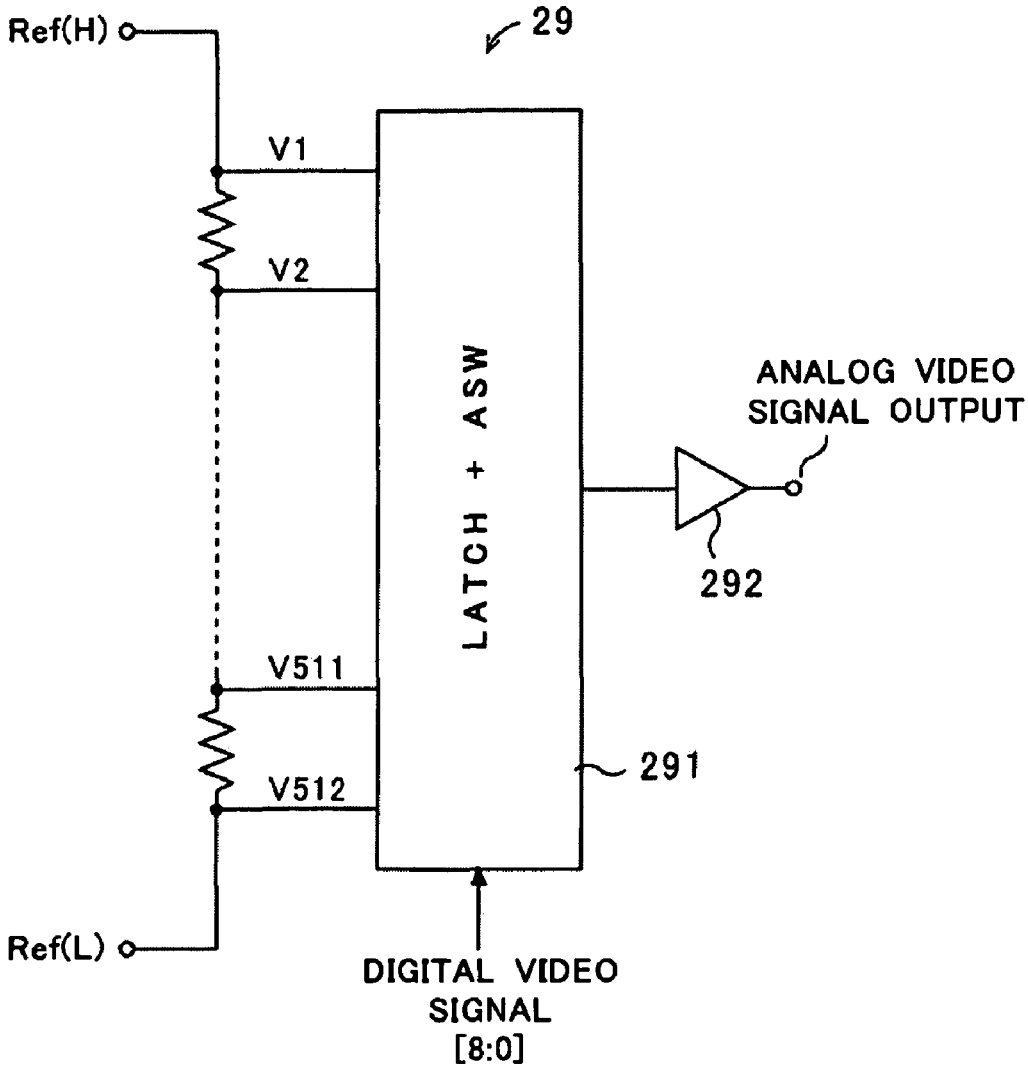
FIG. 3 is a circuit diagram of a first polarity switching circuit 28A of FIG. 2.

The first D/A converter 29 has ($2^9$-1) pieces of ladder resistors as shown in FIG. 3 when the digital video signal is made of 9-bit digital data, and the reference potential Ref(H) on the high potential side from the second D/A converter 30 and the reference potential Ref(L) on the low potential side from the third D/A converter 31 are applied to the ladder resistors at both ends. Then, one of 512 potentials (V1, V2, . . . V512) divided by the ladder resistors is selected and held by an analog switch+latch circuit 291 in response to the digital video signal. This held potential is outputted as an analog video signal through an analog amplifier 292.

Next, when the positive polarity digital video signal is inputted to the first polarity switching circuit 28A, the switch SW is switched in response to a mode switching signal and the positive polarity digital video signal is inputted to the first D/A converter 29 through an inverting amplifier 284 of the first polarity switching circuit 28A, as shown in FIG. 4. That is, the positive polarity digital video signal is inputted to the first D/A converter 29 after it is inverted. The inverting amplifier 284 inverts binary data ("1" or "0") of each of the bits of the positive polarity digital video signal. That is, the amplifier 284 inverts the binary data "1" of a bit into "0" or the binary data "0" into "1".

Reference data on the high potential side from the color correction circuit 24 corresponds to the white level, and is inputted to the third D/A converter 31 through the inverting amplifier 285. Reference data on the low potential side from the ACL circuit 27 corresponds to the black level, and is inputted to the second D/A converter 30 through the inverting amplifier 286. The inverting amplifiers 285 and 286 invert binary data ("1" or "0") of each of the bits of the reference data. Then, an analog video signal is outputted from the first D/A converter 29. In this manner, when the negative polarity digital video signal is inputted, the polarity switching circuit 28 lets the negative polarity digital video signal pass therethrough without inverting its polarity, if the display panel 10 is made for the negative polarity video signal. When the positive polarity digital video signal is inputted, the polarity switching circuit 28 inverts the polarity of the digital video signal, and inverts and switches the reference data for the white level and the reference data for the black level in order to obtain an accurate inverted image.

When the display panel 10 is made for the positive polarity video signal (the display panel having the pixels of FIG. 6), to the contrary, when the positive polarity digital video signal is inputted, the polarity switching circuit 28 lets the signal pass therethrough without inverting its polarity. When the negative polarity digital video signal is inputted, the polarity switching circuit 28 inverts the polarity of the digital video signal, and inverts and switches the reference data for the white level and the reference data for the black level.

The display device of this embodiment can provide the self-emission type display device that is usable for both the negative and positive polarity video signals by switching the polarity of the video signal depending on whether the video signal is of the negative polarity or the positive polarity. Particularly, since the white level and the black level are switched depending on whether the video signal is of the negative polarity or the positive polarity, an accurate inverted image can be displayed.

What is claimed is:

1. A self-emission type display device comprising:

a panel;

a polarity switching circuit disposed in the panel and receiving and outputting a digital video signal, the polarity switching circuit being configured to output the digital video signal without inverting a polarity thereof when the polarity of the received digital video signal is a first polarity and to invert the digital video signal so as to be of the first polarity and output the inverted digital video signal when the polarity of the received digital video signal is a second polarity that is opposite to the first polarity;

a first D/A converter disposed in the panel and converting the digital video signal output by the polarity switching circuit with or without the inversion to an analog video signal;

a plurality of self-emissive elements disposed in the panel and each emitting light based on a drive current supplied to the self-emissive elements in response to the analog video signal, the self-emissive elements being configured to operate in response to the digital video signal of the first polarity and not in response to the digital video signal of the second polarity, the self-emission type display device being configured to receive the digital video signal of the first polarity and the digital video signal of the second polarity, and when the self-emission type display device receives the digital video signal of the first polarity, the self-emissive elements being configured to operate only in response to the non-inverted digital video signal of the first polarity supplied from the polarity switching circuit to display an image corresponding to the digital video signal of the first polarity, and when the self-emission type display device receives the digital video signal of the second polarity, the self-emissive elements being configured to operate only in response to the inverted digital video signal of the second polarity supplied from the polarity switching circuit to display an image corresponding to the digital video signal of the second polarity;

an additional polarity switching circuit receiving first reference digital data and second reference digital data and configured to output received first and second reference digital data without inversion when the polarity of the digital video signal received by the polarity switching circuit is the first polarity and to output inverted first and second reference digital data when the polarity of the digital video signal received by the polarity switching circuit is the second polarity;

a second D/A converter receiving the first reference digital data output by the additional polarity switching circuit with or without the inversion, converting the first reference digital data to a first analog reference voltage and supplying the first analog reference voltage to the first D/A converter; and a third D/A converter receiving the second reference digital data output by the additional polarity switching circuit with or without the inversion, converting the second reference digital data to a second analog reference voltage and supplying the second analog reference voltage to the first D/A converter.

2. The self-emission type display device of claim 1, further comprising a driving transistor supplying the drive current to a corresponding self-emissive element.

3. The self-emission type display device of claim 1, further comprising a color correction circuit, an adjusting circuit for contrast and brightness and a gamma correction circuit that process the digital video signal.

4. The self-emission type display device of claim 3, further comprising an automatic contrast limiter circuit outputting the first reference digital data for adjusting a white level for the digital video signal processed by the gamma correction circuit.

5. The self-emission type display device of claim 3, wherein the color correction circuit outputs the second reference digital data for adjusting a black level for the digital video signal.

6. The self-emission type display device of claim 1, wherein each of the self-emissive elements comprises an organic electroluminescent element.

* * * * *